US005722009A

United States Patent [19]

Haneda et al.

[11] Patent Number: 5,722,009

[45] Date of Patent: Feb. 24, 1998

[54] COLOR IMAGE FORMING APPARATUS HAVING A TRANSPARENT IMAGE FORMING DRUM WITH DETECTORS INSIDE OF THE DRUM

[75] Inventors: Satoshi Haneda; Hiroyuki Tokimatsu, both of Hachioji, Japan

[73] Assignee: Konica Corporation, Tokyo, Japan

[21] Appl. No.: 753,782

[22] Filed: Dec. 2, 1996

[30] Foreign Application Priority Data

Dec. 6, 1995 [JP] Japan ..... 7-318080

[51] Int. Cl.[6] ..... G03G 15/00

[52] U.S. Cl. ..... 399/60; 399/21; 399/40; 399/49; 399/66

[58] Field of Search ..... 399/60, 39, 40, 399/49, 66, 72; 347/178, 115–119, 177, 139, 232, 262, 264

[56] References Cited

U.S. PATENT DOCUMENTS 5,278,625 1/1994 Charnitski et al. ..... 399/178
5,541,722 7/1996 Ikeda et al. ..... 399/178

FOREIGN PATENT DOCUMENTS 5-281761 10/1993 Japan .
5-307307 11/1993 Japan .

OTHER PUBLICATIONS

Translation of 06–130875.

*Primary Examiner*—Arthur T. Grimley
*Assistant Examiner*—Quana Grainger
*Attorney, Agent, or Firm*—Frishauf, Holtz, Goodman, Langer & Chick

[57] ABSTRACT

In a color image forming apparatus, plural different colored toner images are sequentially formed on an image forming body by repeating respective operations of plural chargers, plural imagewise exposure devices and plural developing devices so that a superimposed color image is formed on the image forming body. The color image forming apparatus further includes a detector provided inside and facing the image forming body, downstream of a developing device located in a most downstream position among the plural developing devices, for detecting the superimposed color image on the image forming body.

24 Claims, 10 Drawing Sheets

COLOR IMAGE FORMING APPARATUS HAVING A TRANSPARENT IMAGE FORMING DRUM WITH DETECTORS INSIDE OF THE DRUM

BACKGROUND OF THE INVENTION

The present invention relates mainly to an electrophotographic type color image forming apparatus in which a plurality of image exposure means are housed in a drum-like image forming body, around which a plurality of chargers and developing devices are arranged, with which a color image is formed by superimposing a toner image during a single rotation of the image forming body.

As multi-color image forming apparatus, the following apparatus are generally known: a color image forming apparatus (A) in which the same number of photoreceptors, chargers, developing devices as the number of necessary colors are provided, and a monochromatic toner image formed on each photoreceptor is superimposed on an intermediate transfer body, or similar devices, to form a color image; a color image forming apparatus (B) in which a single photoreceptor is rotated plural times, and charging, image exposure, and developing are repeated for each color to form a color image; and a color image forming apparatus (C) in which charging, image exposure, and developing are successively conducted for each color during one rotation of a single photoreceptor to form a color image.

However, the apparatus (A) requires a plurality of photoreceptors and an intermediate transfer body, resulting in a disadvantageous increase in overall size of the apparatus. The apparatus (B) has only one charging means, image exposure means, and photoreceptor, and therefore, the overall size of the apparatus is decreased, however, it has the limitation in that the size of the image is limited to less than the surface area of the photoreceptor.

Although the apparatus (C) can form an image at high speed, it requires that a plurality of sets of a charger, an image exposure means, and a developing device are provided around the periphery of the photoreceptor. Further in the apparatus (C), there is the possibility that the optical system which conducts image exposure is stained by toner leaked from the adjoining developing device, which reduces the image quality. In order to avoid that, it is required to enlarge the interval between the image exposure means and the developing device, whereby the diameter of the photoreceptor is inevitably increased, resulting in an increase of the overall apparatus.

In order to avoid the disadvantages of the apparatus (C), an apparatus has been proposed, (for example, Japanese Patent Publication Open to Public Inspection No. 307307/1992), in which the base body of the image forming body is formed of a transparent material; a plurality of image exposure means are housed inside the image forming body; and an image is exposed on a photoreceptor layer formed on the outer periphery of the base body through the transparent base body.

In this connection, in these image forming apparatus, normally, detectors to detect toner formed on the surface of the image forming body are arranged around the image forming body. However, inside the image forming apparatus, stray toner tends to adhere onto the surface of the detector, and the surface of the detector is therefore stained, resulting in a decrease of detecting accuracy. Further, specifically in a color image forming apparatus, a plurality of developing devices are arranged to form a plurality of toner images. When a detector is provided for each toner image, fluctuations occur among the detectors, and the detecting accuracy is relatively decreased.

SUMMARY OF THE INVENTION

The present invention has been accomplished to solve the above problems, and an object of the present invention is to provide a color image forming apparatus in which the detecting accuracy is not decreased by toner stains, and which can detect toner on the image forming body at a high degree of accuracy.

Further, it is necessary that a plurality of toner images formed on the image forming body are completely superimposed on each other, and this is attained by electrically compensating for deviations of the image exposure position on the image forming body caused by the image exposure means. In order to compensate for poor registration, the registration compensation is carried out by forming a registration pattern on the image forming body, and by detecting the pattern by a registration detecting means. Another object of the present invention is to provide a color image forming apparatus in which a highly accurate registration detecting means is provided in which the detecting accuracy is not decreased by toner stains or the like.

Further, in order to obtain a color image having excellent reproducibility, it is necessary to control the amount of toner adhesion on the image forming body for each color. For this, the following is necessary: a density pattern for each color is formed on the image forming body; the density of this density pattern is detected by a density detection means; and an image control is conducted according to the detected density patterns. Another object of the present invention is to provide a color image forming apparatus in which a highly accurate detection means is provided in which the detecting accuracy is not decreased by toner stains or the like.

Further, the optimum transfer condition when a color image in which multi-color toner images are superimposed on each other, is transferred on a recording sheet, is different from the optimum conditions when a monochromatic toner image is transferred onto the recording sheet. The optimum transfer condition is a transfer condition having a high transfer coefficient. Another object of the present invention is to provide a color image forming apparatus provided with a residual toner amount detection means, which can detect a toner remaining on the image forming body during transfer processing, with high accuracy, and in which the detection accuracy is not decreased by toner stains.

The above object can be attained by a color image forming apparatus comprising:

an image forming body;

a plurality of chargers;

a plurality of image exposure means;

a plurality of developing means which develop corresponding images by toners of different colors, wherein a different color toner image is successively formed on an image forming body by the plurality of chargers, image exposure means, and the plurality of developing devices, and a color toner image is formed in which a plurality of color toner images are superimposed on the image forming body; and the color image forming apparatus further comprising a detection means to detect a toner image on the image forming body, wherein the detection means is arranged inside the image forming body, and is arranged opposed to the image forming body at a position downstream of the most downstream one of the plurality of developing means.

BRIEF DESCRIPTION OF THE DRAWINGS

FIGS. 9(*b*)-1, 9(*b*)-2, and 9(*b*)-3 are illustrations showing how to obtain γ-characteristics.

FIG. 14(*b*) is a plan view of the recording sheet detection means.

DETAILED DESCRIPTION OF THE PREFERRED EMBODIMENT

Figure 1:
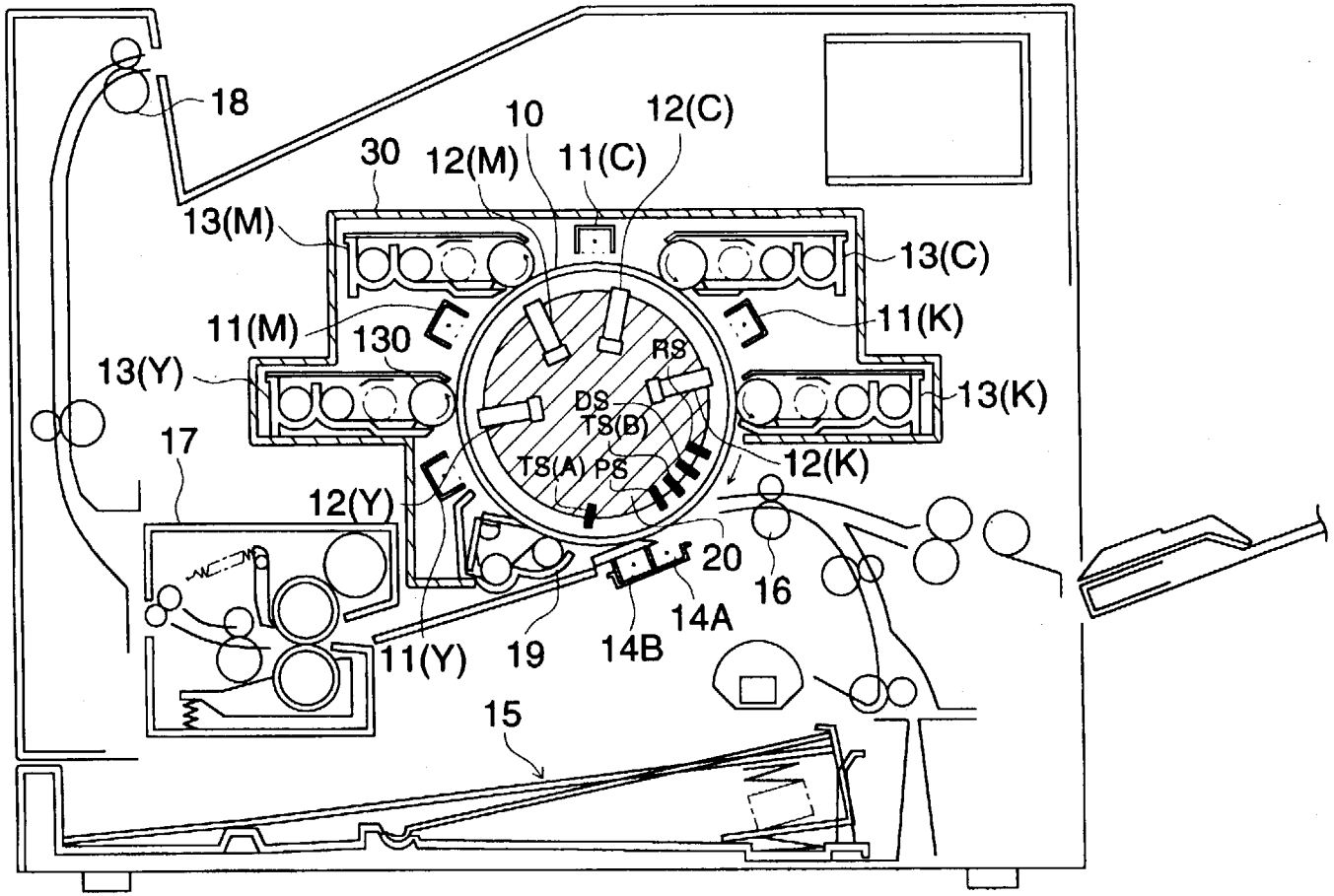
FIG. 1 is a sectional structural view showing an example of a color image forming apparatus of the present invention.
Figure 2:
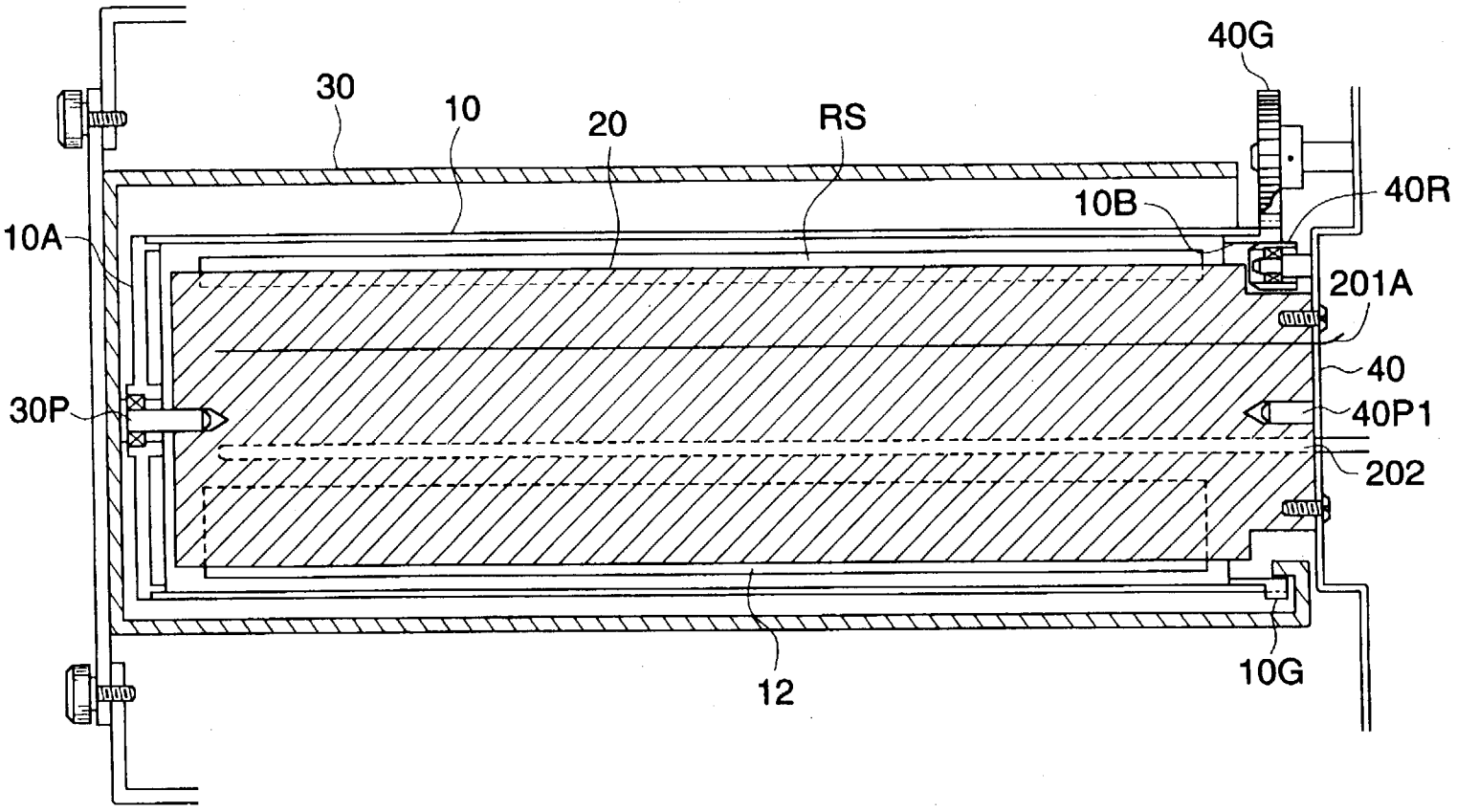
FIG. 2 is a partial sectional view of members relating to image formation in the axial direction of an image forming body.

Prior to an explanation of an example of the present invention, the structure of an example of a color image forming apparatus common to the present invention will be described below referring to FIGS. 1 and 2.

Numeral 10 is a drum-like image forming body, that is, a photoreceptor drum, in which a 15–50 μm thick transparent conductive layer and an organic photosensitive layer (0PC) are coated on the outer periphery of a cylindrical base body having a diameter of 70–150 mm, and the thickness of 2–10 mm, which is formed of a transparent member such as optical glass or transparent acrylic resin.

This photoreceptor drum is sensitive to a red component (near the wavelength of 700 nm), and is transparent to infrared rays, specifically to far-infrared rays (the wavelength is 2800 nm) and has no optical sensitivity to them. For detection light of the present invention, the infrared rays are preferably used as described later.

A flange 10A at one end of the photoreceptor drum 10 is supported through a bearing by a guide pin 30P provided on a cartridge 30 (which will be described later). A flange 10B at the other end of the photoreceptor drum 10 is engaged from outside with a plurality of guide rollers 40R provided on a base plate 40 of the apparatus main body, a gear 10G provided on the outer periphery of the flange 10B is engaged with a drive gear 40G, and the photoreceptor drum 10 is rotated clockwise by the driving force of the drive gear 40G, while the transparent conductive layer is electrically grounded.

Numerals 11 (Y, M, C, K) are scorotron chargers, which carry out charging by corona discharge by a grid, having a predetermined potential voltage with respect to the organic photoreceptor layer on the photoreceptor drum 10, and a discharge wire, and by which a uniform potential voltage is applied onto the photoreceptor drum 10.

Numerals 12 (Y, M, C, K) are an exposure optical system composed of LED arrays, which are arranged in the direction of the shaft of the photoreceptor drum 10, which have a light emitting wavelength of 680 nm, and a Selfoc lens. Each color image signal which is read by an image reading device, provided separately from the apparatus, and image-processed, is successively read from a memory and respectively inputted into each exposure optical system 12 as an electrical signal.

Each linear exposure optical system 12(Y, M, C, K) is mounted on a cylindrical or a polygonal prismatic supporting member 20 which is fixed by a guide pin 40P1 as a guide onto the base plate 40 of the apparatus, and is housed inside the base body of the photoreceptor drum 10. Each exposure optical system 12 (Y, M, C, K) is accurately and linearly arranged in the direction perpendicular to the moving direction of the photoreceptor drum 10.

Numerals 13Y, 13M, 13C, and 13K are developing devices in which yellow (Y), magenta (M), cyan (C) and black (K) developing agents are respectively accommodated, and each of them has a developing sleeve 130 which is rotated in the same direction, at a developing point as the photoreceptor drum 10 with a predetermined gap from the peripheral surface of the photoreceptor drum 10.

Each developing device 13(Y, M, C, K) non-contact reversal-develops an electrostatic latent image, formed through charging by the chargers 11(Y, M, C, K) and by image exposure by the exposure optical systems 12(Y, M, C, K) on the photoreceptor drum 10, by applying a developing bias voltage.

Next, color image forming processes in the apparatus will be described.

Document images are read by an image reading apparatus, provided separately from this apparatus, and images read by an image pick-up element or edited by a computer, are temporarily stored in a memory as separate color image signals for Y, M, C and K.

The drive gear 40G is rotated by the start of a photoreceptor drive motor at the start of image recording, the photoreceptor drum 10 is rotated clockwise, and simultaneously, a potential voltage is applied onto the photoreceptor drum 10 by the charging action of the charger 11(Y).

After the photoreceptor drum 10 has been provided with a potential voltage, exposure, due to electrical signals corresponding to an image signal of the first color signal, that is yellow, is started in the exposure optical system 12(Y), and an electrostatic latent image corresponding to an image of the yellow (Y) portion of the document image, is formed on the photoreceptor layer on the surface of the photoreceptor drum by its rotational scanning.

The latent image is reversal-developed by the developing device 13(Y) under the condition that developing agent on the developing sleeve is in non-contact with the photoreceptor layer, and a yellow (Y) toner image is formed corresponding to the rotation of the photoreceptor drum 10.

Next, the photoreceptor drum 10 is further provided with a potential voltage on the yellow (Y) toner image by the charging action of the charger 11(M); exposure is carried out due to electrical signals corresponding to the image signal of the second color signal of the exposure optical system 12(M), that is, the magenta (M) image signal, and a magenta (M) toner image is formed by successively being superimposed on the yellow (Y) toner image by non-contact reversal-development by the developing device 13(M).

By the same process, a cyan (C) toner image corresponding to the third color signal is further formed by being superimposed on the above toner images, by the charger 11(C), exposure optical system 12(C) and developing device 13(C); a black (K) toner image is successively formed by being superimposed on the above three toner images, by the charger 11(K), exposure optical system 12(K), and developing device 13(K); and a color toner image is formed on the periphery of the photoreceptor drum 10 during its one rotation.

Exposure onto the organic photoreceptor layer of the photoreceptor drum 10 by these exposure optical systems 12 (Y, M, C, K) is carried out through the transparent base body from the inside of the drum. Accordingly, exposure of the image corresponding to the second, the third, and the fourth color signals is carried out being barely influenced by previously formed toner images, and the latent image approximately equal in quality to the image corresponding to the first color signal, can be formed. In this connection, stabilization of temperature inside the photoreceptor drum 10, caused by heat of the exposure optical system 12(Y, M, C, K), and prevention of temperature rise thereof can be carried out by the following means. The temperature rise inside the photoreceptor drum 10 can be suppressed to the degree in which no hindrance occurs to the image forming process, by means in which: good heat conductive material is used for the supporting member 20, a heater 201A is used for low temperature, or heat is dissipated outside through a heat pipe 202 when high temperatures exist. Further, when developing is carried out by each developing device, a developing bias voltage, in which AC voltage is superimposed on DC voltage, is applied on each developing sleeve; jumping development by one- or two-component developer accommodated in the developing device, is carried out; and non-contact reversal development is carried out with respect to the photoreceptor drum 10 in which a transparent conductive layer is electrically grounded.

A color toner image formed on the peripheral surface of the photoreceptor drum 10 is transferred by a transfer device 14A onto the recording sheet which is conveyed from a sheet feed cassette 15 and synchronized with the movement of the photoreceptor drum by the drive of a timing roller 16.

The transfer sheet onto which a toner image has been transferred, is discharged by a discharger 14B and is separated from the peripheral surface of the drum, a toner is fused by a fixing device 17, and after that, the recording sheet is delivered through a delivery roller 18 onto a tray in the upper portion of the apparatus.

Any remaining toner on the peripheral surface of the photoreceptor drum 10 after transferring, is removed by a cleaning device 19, and the apparatus is ready for the next image formation.

(EXAMPLE 1)

Figure 3:
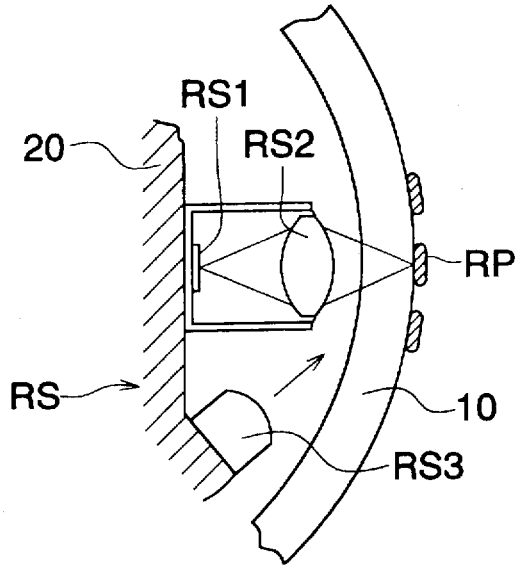
FIG. 3 is a sectional view of a first example (a registration detection means).
Figure 4:
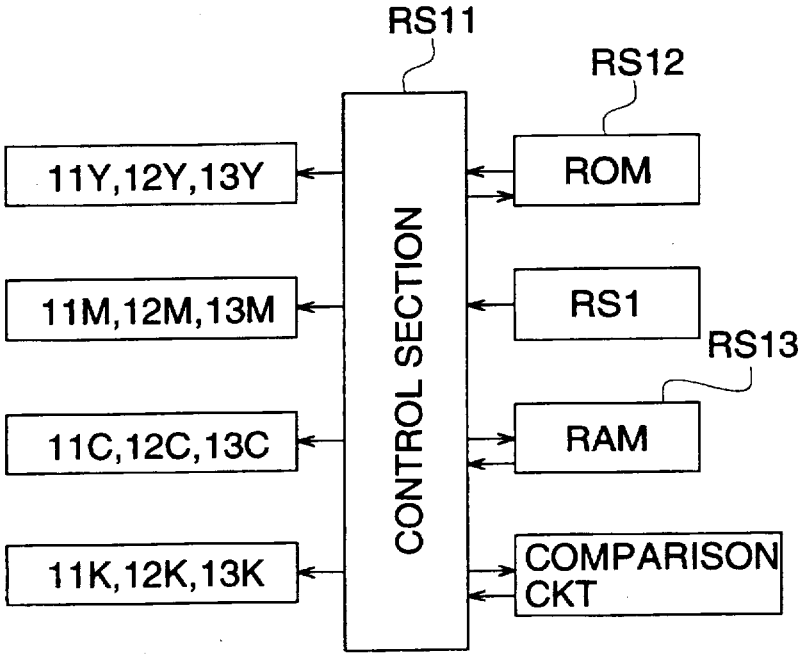
FIG. 4 is a circuit block diagram of the first example.

This example is structured such that a registration detection means RS common to a plurality of developing devices 13(Y, M, C, K) is provided on the supporting member 20 within a range between a portion downstream of the developing device 13(K) and a cleaning apparatus 19, inside the photoreceptor drum 10; and a registration pattern formed on the peripheral surface of the photoreceptor drum 10 is detected, and registration adjustment is carried out among exposure optical systems 12(Y), 12(M), 12(C) and 12(K). FIG. 3 shows a sectional view of the registration detection means RS, and FIG. 4 shows a circuit block diagram. In FIG. 3, RS1 represents an image sensor such as a CCD, or the like. A line-type or an area-type image sensor RS1 is provided in parallel with the shaft of the photoreceptor drum 10, an image formation lens RS2 is provided in front of the image sensor RS1, and this system is structured so that a registration pattern image RP formed on the peripheral surface of the photoreceptor drum 10 is formed on the image sensor RS1. RS3 is a light emitting element to illuminate the registration pattern image from the inside of the photoreceptor drum 10. As a detection light, infrared rays which penetrate the base body of the photoreceptor drum 10 are preferably used, and for the image sensor RS1, a sensor which is sufficiently sensitive to infrared rays, is also preferably used. Incidentally, in the present example, although the light emitting element RS3 radiates from the inside of the photoreceptor drum 10, and the registration detection is carried out using its reflected light, a light emitting element RS3 may be provided at a position opposed to the image sensor RS1 outside the photoreceptor drum 10, and the registration detection may be carried out using such transmitted light. The detection light preferably has a permeability of more than 70% with respect to the photoreceptor drum, in its detection performance. Further, it is preferable that the photoreceptor is not overly photosensitive to the detection light so as to prevent disturbance of toner and optical fatigue of the photoreceptor.

Figure 5:
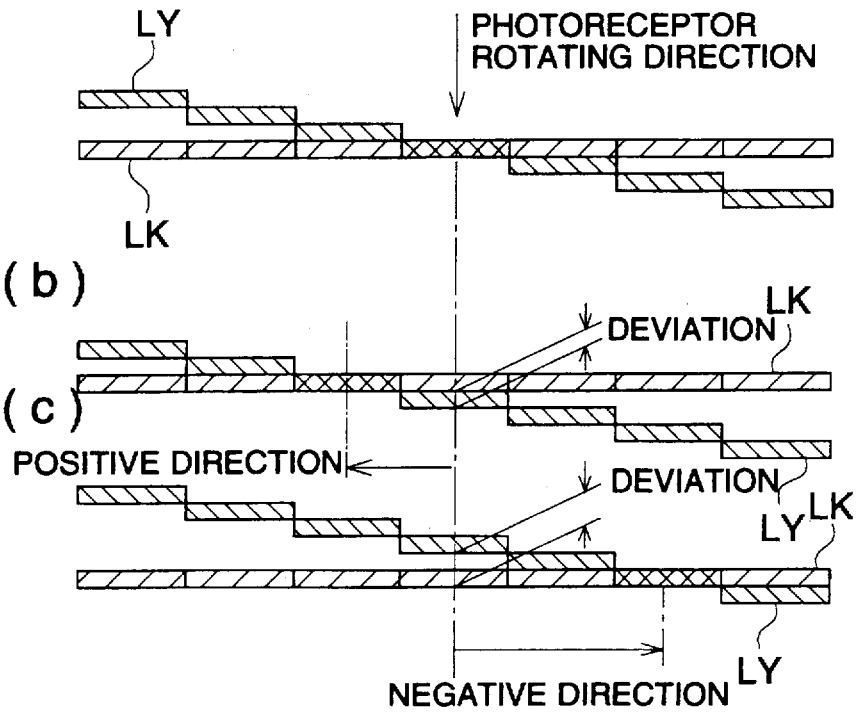
FIGS. 5(*a*), 5(*b*) and 5(*c*) show an example of registration patterns.

When registration adjustment is carried out, a control section RS11 reads out a registration pattern program from a ROM.RS12, and forms a registration pattern on the photoreceptor drum 10 by the exposure optical systems 12(Y, M, C, K) for correction of position deviation of the image. FIGS. 5(*a*), 5(*b*), and 5(*c*) show an example of the registration pattern. For example, black (K) which is most emphasized as an image, is used as a reference, and a registration pattern is formed which is structured so that any deviated amount in the primary scanning direction and the subsidiary scanning direction for each of yellow (Y), magenta (M), and cyan (C), with respect to black (K), can be easily detected. The deviated amount of yellow (Y) with respect to black (K) can be easily detected by the image sensor RS1 such that a yellow line (LY), shifted by several blocks stepwise for each line with respect to linear black line (LK) in the primary scanning direction, is recorded, and both end portions and intersection portion of the two lines are detected. Positional deviation of the end portions with respect to the rotational direction of the photoreceptor represents deviation in the primary scanning direction. The deviation in the primary scanning direction can be adjusted by shifting image data. Next, adjustment of the position in the subsidiary scanning direction will be described. In FIGS. 5(*a*), 5(*b*) and 5(*c*), FIG. 5(*a*) shows a registration pattern in a completely superimposed condition in which there is no deviation between yellow (Y) and black (K). FIG. 5(*b*) shows deviation and a deviated amount of yellow (Y) in the positive direction, and FIG. 5(*c*) shows deviation and a deviated amount in the negative direction. The control section RS11 calculates a deviation correction amount according to the detected deviation direction and deviated amount for each color, and records it in a RAM.RS13. When an image is formed, the registration correction is carried out on the timing of the output of the correction value for each exposure optical system 12(Y), 12(M) and 12(C) so as to correct the deviated direction and the deviated amount.

As described above, when the registration detection means is provided inside the photoreceptor drum and registration correction is carried out, if necessary, an image is always formed which is clear and excellent in reproducibility.

Further, the registration detection means is provided at a portion downstream of the most downstream developing device of a plurality of developing devices, and therefore, the detecting element can be common to the plurality of developing devices, and positions of different toner images can be accurately compared to each other and detected.

In the above description, registration correction is separately carried out in the primary scanning direction and in the subsidiary direction, however, the correction value for the primary scanning and subsidiary scanning can be calculated simultaneously by using patterns shown in FIGS. 5(*a*) through 5(*c*).

The above described registration detection means RS can also be caused to function as a density detection means to detect and control the color density which will be described in the following Example 2.

(EXAMPLE 2)

Figure 6:
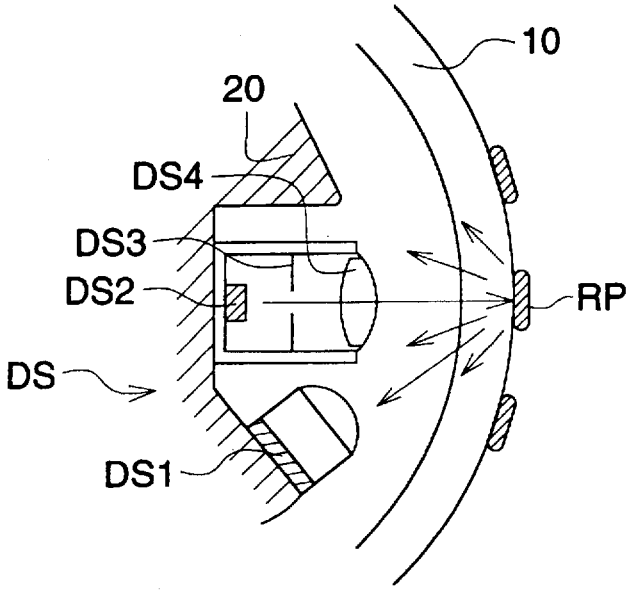
FIG. 6 is a sectional view of a second example (a density detection means).
Figure 7:
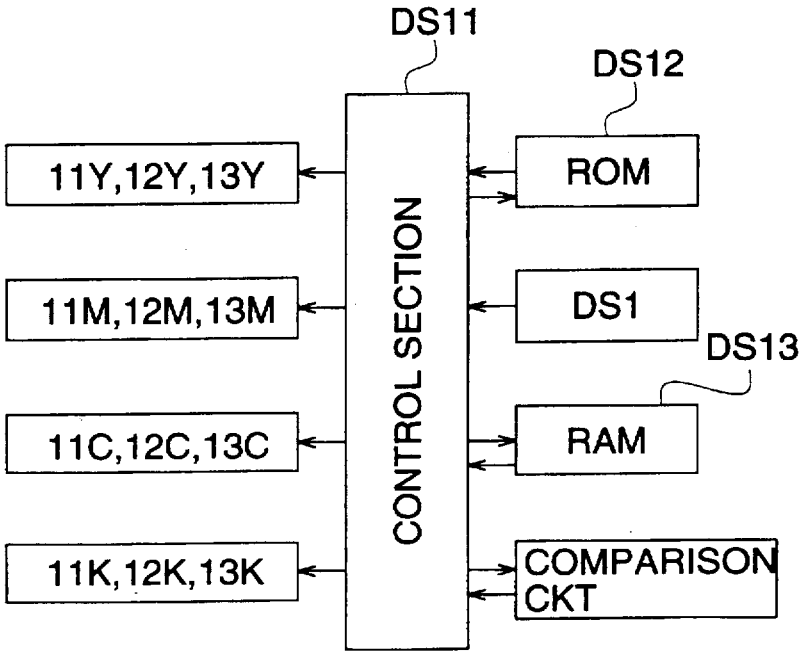
FIG. 7 is a circuit block diagram of the second example.

The present example is structured such that a density detection means DS, which is common to a plurality of developing devices, is provided on a support member 20 inside the photoreceptor drum 10 within a range between a portion downstream of the developing device 13(K) and the cleaning device 19, and density is controlled when the density pattern formed on the peripheral surface of the photoreceptor drum 10 for each color is detected. FIG. 6 shows a sectional view of the density detection means DS, and FIG. 7 shows a circuit block diagram. In FIG. 6, DS1 is a light receiving element composed of a phototransistor, a photodiode or the like, and a DS2 is a light emitting element such as an LED, or the like. This system is structured such that an aperture member DS3 having a small diameter and a light converging lens DS4 are provided in front of the light emitting element DS2; a luminous flux of infrared rays emitted from the light emitting element DS2, which transmit through the base body of the photoreceptor drum 10, forms a spot-like image at the toner image adhesion positions on the peripheral surface of the photoreceptor drum 10; and its reflected light is received by the light receiving element DS1. Incidentally, in the present example, the light emitting element DS2 irradiates rays of light from inside of the photoreceptor drum 10, and density detection is carried out by its reflected light, however, when the light emitting element DS2 is provided at a position opposed to the light receiving element DS1 outside the photoreceptor drum 10, the density detection can be carried out by directly using the transmitted rays of light.

In the detection performance, the detection light preferably has a permeability of more than 70% with respect to the photoreceptor drum. Further, it is preferable that the photoreceptor is not excessively photosensitive to the transmission light so as to prevent disturbance of toner and optical fatigue of the photoreceptor.

Figure 8:
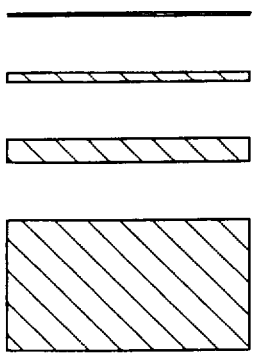
FIGS. 8(*a*) and 8(*b*) show an example of density patterns.
Figure 8:
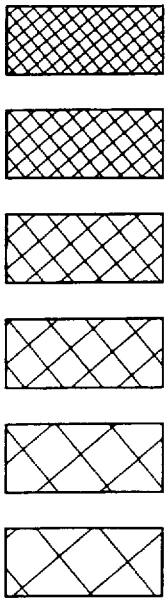

When the density control is carried out, a control section DS11 reads out a density pattern program from a ROM.DS12, a density pattern is formed on the photoreceptor drum 10 by the exposure optical systems 12(Y, M, C, K), and highly accurate image control is carried out by the pattern output and its detection. FIGS. 8(*a*) and 8(*b*) show an example of the density pattern, two patterns of FIGS. 8(*a*) and 8(*b*) are formed for each color, and image control is carried out by detecting the patterns. The pattern shown in FIG. 8(*a*) has an output of the light amount of the exposure optical systems 12(Y, M, C, K) corresponding to solid portions; a plurality of pairs of patterns of 1, 2, . . . n lines are formed in the primary scanning direction with a certain interval among them; and these patterns are non-contact reversal developed by corresponding developing devices 13(Y, M, C, K) under several types of previously set developing bias conditions (frequency f and a peak-to-peak voltage $V_{p-p}$ of an impressed AC bias voltage). Then, a developing bias condition is obtained in which the toner density of a pattern, detected by a light receiving element DS1 shown in FIG. 9(*a*), is more than a predetermined value (the density of 1.35 for black toner), and a developing bias condition of the developing devices 13(Y, M, C, K) is set to that condition. The width of the pattern is provided for ensuring fine line reproducibility in the non-contact development.

Figure 9:
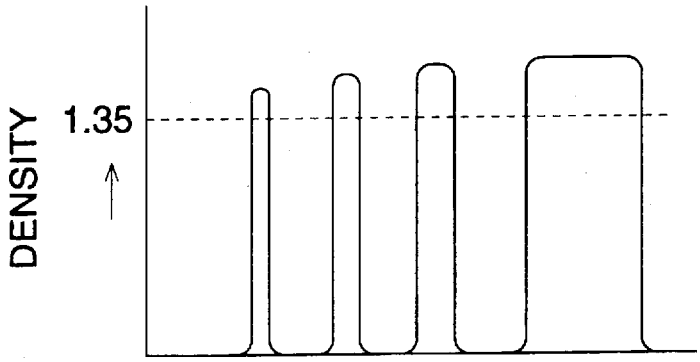
FIG. 9(*a*) is a graph showing the measured density of a pattern.
Figure 9:
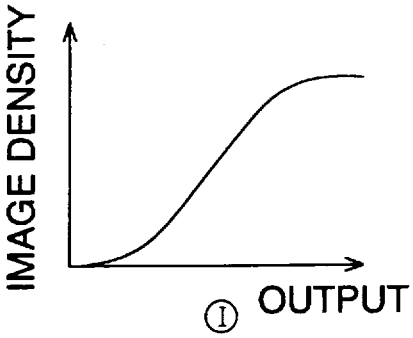
Figure 9:
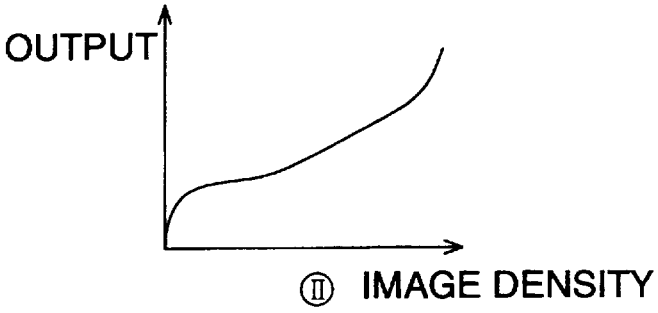
Figure 9:
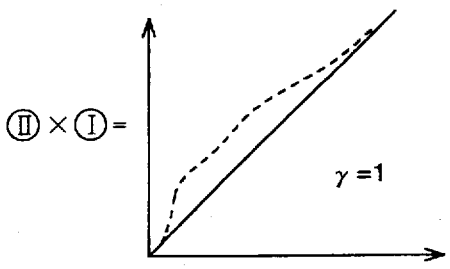

Next, gradation correction is carried out. A density pattern program for gradation correction is read from a ROM.DS12 by the control section D11; a plurality of block-like latent image portions are formed on the photoreceptor drum 10 by the exposure optical systems 12(Y, M, C, K) in which the output has previously been made to differ stepwise by a program for each color; and the latent image portions are non-contact reversal developed under the development bias condition of the corresponding developing devices 13(Y, M, C, K). Patterns for gradation correction, in which the density is different stepwise as shown in FIG. 8(*b*), are formed on the photoreceptor drum 10; gradation correction data which shows the relationship between the output of the exposure optical systems 12(Y, M, C, K) and the density of patterns is interpolated by the light receiving element DS1, and interpolated data forms a continuous curve, as shown in FIG. 9(*b*)-1, which shows characteristics of a printer. When its inverse function is used, it forms a curve as shown in FIG. 9(*b*)-2, which is a gradation correction curve. When the curve in FIG. 9(*b*)-1 and the curve in FIG. 9(*b*)-2 are multiplied, a linear line ($\gamma$=1.0), having an angle of 45° as shown in FIG. 9(*b*)-3, is obtained. These gradation correction curves are stored in the RAM.DS13. When an image is formed, image signals of image data of each color are corrected according to the gradation correction curves read from the RAM.DS13, and after that, the corrected signals are inputted into the exposure optical systems 12(Y, M, C, K) for latent image formation. Thereby, a color image, which has a desirable gradation and excellent reproducibility, is formed. Although $\gamma$ is set to 1 in the gradation correction curve, generally $\gamma$ is set to approximately 1.0 for a half tone image, and is set to obtain a rather high contrast image for characters as shown by the broken line.

(EXAMPLE 3)

A remaining transfer toner detection means TS (A) to detect the amount of toner remaining after transfer, which is adhered to the peripheral surface of the photoreceptor drum 10, is provided on the supporting member 20 inside the photoreceptor drum 10, within the range from a portion downstream of the transfer device 14A to the cleaning device 19. A developability detection means TS (B) to detect any toner amount, adhered to the peripheral surface of the photoreceptor drum 10 after development, is provided on the supporting member 20 inside the photoreceptor drum 10, within the range from a portion downstream of the developing device 13K to a transfer device 14A. The toner amount detected by the developability detection means TS (B) and the amount of toner remaining after transfer detected by the remaining transfer toner detection means TS (A) at corresponding positions are compared to each other, and thereby, a transfer rate is calculation processed.

Figure 10:
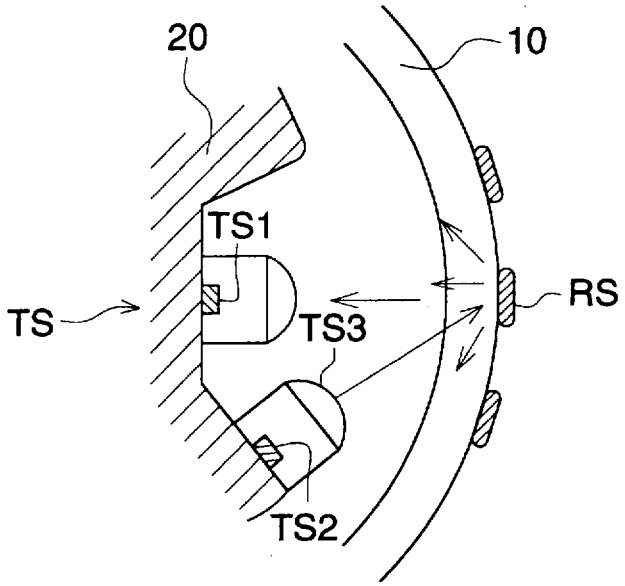
FIG. 10 is a sectional view of a third example (a transfer-remaining toner detection means).
Figure 11:
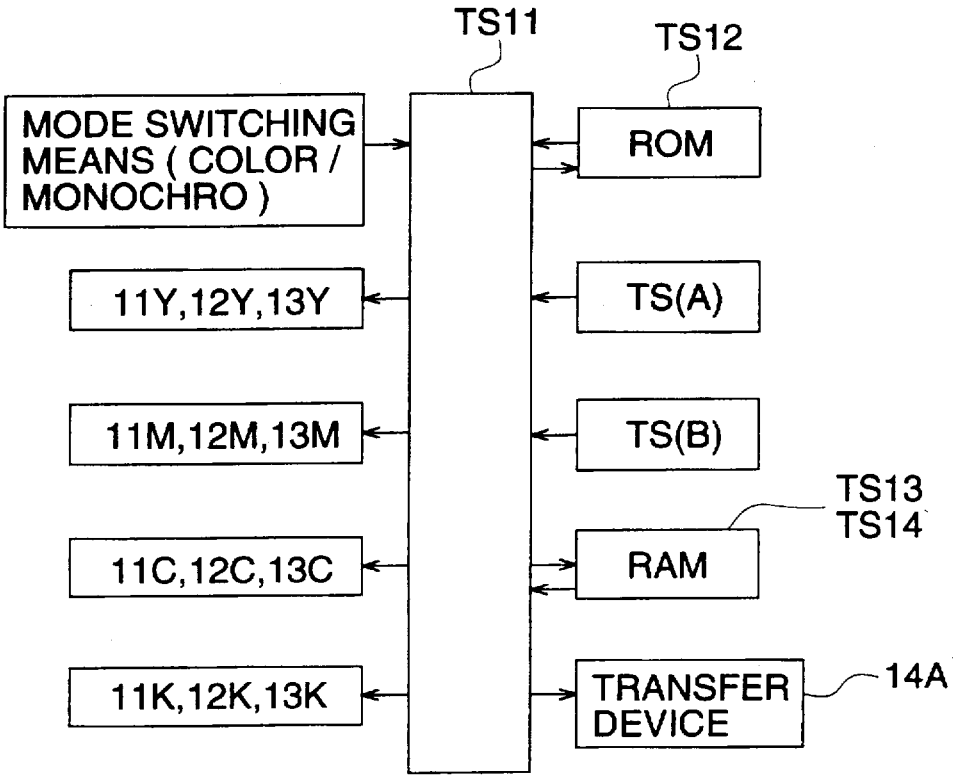
FIG. 11 is a circuit block diagram of the third example.

Detecting portions of the developability detection means TS (B) and the remaining transfer toner detection means TS (A) have the same structure. FIG. 10 shows a sectional view, and FIG. 11 shows a circuit block diagram in the present example. In FIG. 10, TS1 is a light receiving element composed of a phototransistor, a photodiode, or the like, and TS2 is a light emitting element such as an LED, or the like. A light collection lens TS3 is provided in front of the light receiving element TS2. The infrared rays emitted from the light emitting element TS2 are formed into a predetermined shape at the toner adhesion position on the peripheral surface of the photoreceptor drum 10 with a predetermined amount of light, and the light receiving element TS1 receives the amount of reflected light. Incidentally, in the present example, although the light emitting element TS2 detects any adhered amount of toner by reflected light of irradiated light from the inside of the photoreceptor drum 10, the light emitting element TS2 may also be provided at a position opposed to the light receiving element TS1 outside the photoreceptor drum 10, and may detect the adhesion amount of toner by a transmitted light.

Figure 12:
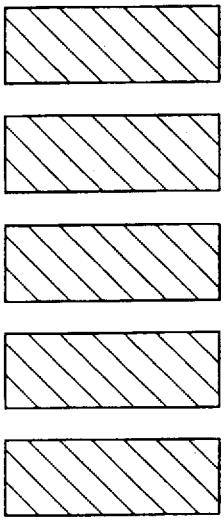
FIG. 12 shows an example of a transfer pattern.
Figure 13:
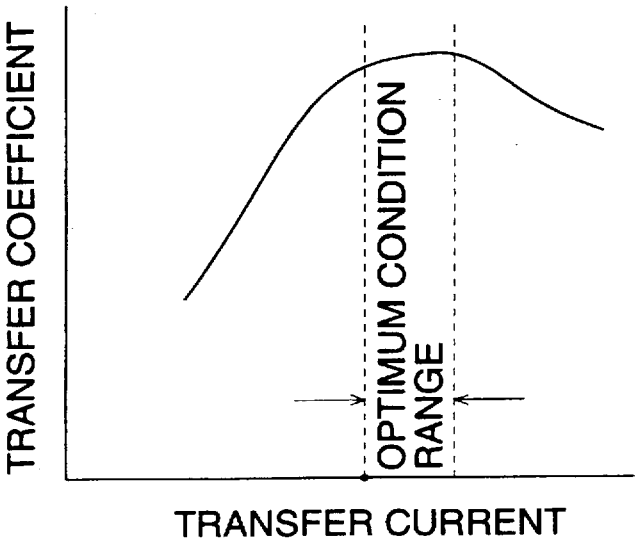
FIG. 13 is a graph showing the relationship between a transfer current and a transfer coefficient.
Figure 14:
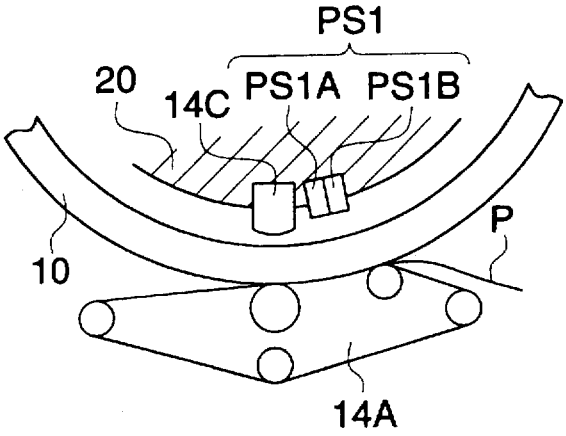
FIG. 14(*a*) is a sectional view of a recording sheet detection means.
Figure 14:
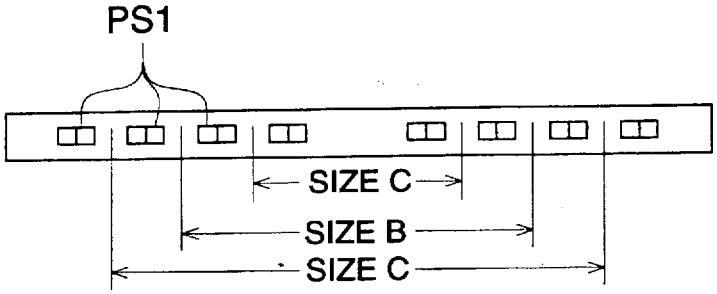

When a transfer rate is measured and an optimum transfer condition is set, a control section TS11 reads a pattern program for transfer condition settings from a ROM.TS12, and a plurality of solid color toner patterns and a plurality of monochromatic toner patterns, for example, as shown in FIG. 12, are formed on a plurality of area portions on the photoreceptor drum 10 in its rotational direction, by the overall exposure by the exposure optical system 12 and by development by the developing device 13. The amount of toner adhered from the plurality of color toner patterns and monochromatic toner patterns is detected by the light receiving element TS (B) 1 of the developability detection means TS (B), and detected data are stored in a RAM.TS13. Color toner patterns and monochromatic toner patterns are transferred onto a recording sheet by a transfer device 14A after the amount of toner adhesion has been detected. In this case, transfer is carried out by a transfer current which is different for each toner pattern according to a predetermined program. In this connection, in the transfer device 14A, when a transfer belt is used as shown in FIGS. 14(*a*) and 14(*b*), the patterns are transferred onto the transfer belt even if the recording sheet is not sent, and therefore, the transfer condition can be controlled without using a recording sheet. Any remaining toner of the plurality of color toner patterns and the plurality of monochromatic patterns after transferring, is detected by the light receiving element TS (A) 1 of the remaining transfer toner detection means TS (A), and a transfer rate of toner is calculation processed using the data of the amount of adhered toner stored in the RAM.TS13. FIG. 13 is a graph showing the relationship between the transfer current and the transfer rate. The control section TS11 determines the transfer current at optimal conditions in which the transfer rate is highest, and sets it as the transfer condition when an image is formed. In this connection, the optimum transfer current differs depending on the case of a color toner image formed by superimposing toner images on the photoreceptor drum 10, and the case of a monochromatic toner image. Accordingly, the transfer condition obtained from the color toner pattern and that obtained from the monochromatic pattern are respectively recorded in a RAM.TS14, and are switched to a color mode and a monochromatic mode. When an image is formed, the control section TS11 reads the transfer condition appropriate for each case from the RAM.TS14, and a constant current control is carried out on the transfer device 14A.

In the photoreceptor drum 10 in which a photoreceptor layer is provided on the transparent base body, when a light emitting portion 14C is provided inside the drum at a portion opposed to the transfer device 14A, and simultaneous exposure is carried out from the inside of the photoreceptor drum 10 at the time of transferring, the transfer rate is increased. However, the transfer rate also differs depending on the amount of emitted light from a light emitting portion RS20. Accordingly, the transfer rate is also used for a light amount control, in which transfer is carried out by changing the amount of emitted light from the light emitting portion 14C, instead of controlling the transfer current, or by changing the amount of emitted light together with the transfer current, and the optimum amount of the emitted light from the light emitting portion 14C is set from a condition in which the transfer rate is highest.

The remaining transfer toner detection means TS (A) of the present invention is provided downstream of the transfer device 14A, and thereby, sheet jamming can also be detected. That is, when conveyance failure of recording sheets occurs, in which the recording sheet to be conveyed after transferring adheres onto the peripheral surface of the photoreceptor drum 10 and consequently is wound around the drum surface, and this condition continues, the remaining transfer toner detection means TS (A) can detect that the recording sheet is under adhered condition onto the drum surface, and the detection means can also be structured such that it can also detect sheet jamming.

In this case, in detection performance, the detection light preferably has the permeability more than 70% with respect to the photoreceptor drum. Further, it is preferable that the photoreceptor has no excessive photosensitivity to the transmission light, so as to prevent disturbance of toner and optical fatigue of the photoreceptor.

A recording sheet detection means PS attached to the supporting member 20 is provided at a position slightly upstream of the transfer device 14A in the photoreceptor drum 10, and detects the recording sheet conveyed onto the photoreceptor drum 10.

FIGS. 14(*a*) and 14(*b*) show the transfer sheet detection means PS. As shown in FIG. 14(*a*), a plurality of photocouples PS1, composed of a light emitting element PS1A to emit infrared rays, and PS1B to receive the reflected rays of light, are arranged parallel to the drum shaft as shown in FIG. 14(*b*), and each photocoupler is structured so as to detect whether the recording sheet is adhered onto the photoreceptor drum 10, or not. Accordingly, depending on the condition of the recording sheet detection by the photocoupler PS1, the following can be carried out: (1) detection of the width of the recording sheet; or (2) detection of the leading edge and the trailing edge of the recording sheet. Further, by increasing the sensitivity of the photocoupler PS1, it can be discriminated whether the recording sheet is a transparent sheet or paper sheet.

Figure 15:
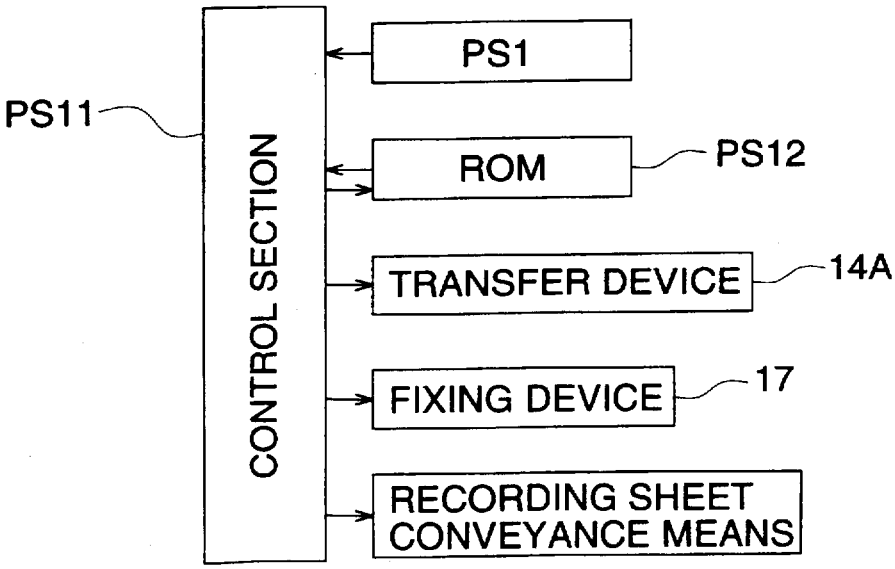
FIG. 15 is a circuit block diagram.

FIG. 15 shows a circuit block diagram, whereby the control section PS11 controls the transfer device 14A according to detection information of the recording sheet detection means PS. Although transferring by the transfer device 14A is carried out by the constant current control, the value of the constant current required for good transferring is different depending on the size of the recording sheet, or the type of recording sheet such as a transparent sheet or a paper sheet. The control section PS11 reads the corresponding current value from the ROM.PS12 according to size detection information for the recording sheet by the recording sheet detection means PS, and controls the value of the constant transfer current in the transfer process. Simultaneously, the control section PS11 controls the impression time period of the transfer voltage at the transfer device 14A according to the detection of the leading edge and the trailing edge of the recording sheet by the recording sheet detection means PS. Further, when the recording sheet detection means PS detects a transparent sheet, the control section PS11 reads the value of the transfer current for the transparent sheet from the ROM.PS12, and sets fixing temperature for the transparent sheet in the fixing device 17.

Since the recording sheet detection means PS has the above functions, an appropriate transfer condition can be set not only to a regular recording sheet but also to an irregular sized recording sheet which is inserted by the sheet-bypass, resulting in excellent transfer images.

Further, in addition to the above functions, the recording sheet detection means PS can be added by a function in which, when the leading edge of the recording sheet is not detected within a predetermined time period, it judges that imperfect recording sheet conveyance has occurred, and raises an alarm or stops the operation.

In this case, in detection performance, the detection light preferably has a permeability of more than 70 % with respect to the photoreceptor drum. Further, it is also preferable that the photoreceptor has no excessive photosensitivity to the transmission light so as to prevent disturbance of toner and optical fatigue of the photoreceptor.

In the color image forming apparatus of the present invention in which an image forming body, in which a photoreceptor layer is provided on a transparent base body, is used, and a color image is formed on the image forming body by superimposing toner images, at least any of a registration detection means, density detection means, toner detection means, and recording sheet detection means, is provided. In conventional apparatus of this type, since a detection means is provided near the outer peripheral portion of the image forming body, toner, or the like, adheres onto the detection means and the performance of the detection means is lowered in a short period of time. However, in the present invention, the detection means is protected by the image forming body, and thereby, reliable detection can be attained for a long period of time.

Further, the detection means is provided downstream of the most downstream developing device of a plurality of developing devices, and thereby, a detection element can be common to the plurality of developing devices, and highly accurate detection can be attained, without fluctuation for each color toner image.

What is claimed is:

1. A color image forming apparatus comprising:

(a) an image forming body having a transparent characteristic;

(b) a plurality of chargers for charging the image forming body;

(c) a plurality of imagewise exposure devices, each for imagewise exposing the image forming body to form a latent image;

(d) a plurality of developers, each for developing the latent image with toner different from each other, wherein a plurality of different colored toner images are sequentially formed on the image forming body by respective operations of the plurality of chargers, the plurality of imagewise exposure devices and the plurality of developers so that a superimposed color image is formed on the image forming body; and (e) a detector comprising a light emitting element and a light receiving element provided inside and facing the image forming body and provided downstream of a developer located in a most downstream position among the plurality of developers, for detecting the superimposed color image on the image forming body through the image forming body.

2. The color image forming apparatus of claim 1, wherein the detector includes an image sensor to detect a registered pattern comprised of respective colored toners formed on the image forming body.

3. The color image forming apparatus of claim 2, wherein the plurality of imagewise exposure devices are provided inside the image forming body, and the apparatus further comprising a supporting body provided inside the image forming body for supporting the plurality of imagewise exposure devices and the image sensor.

4. The color image forming apparatus of claim 2, wherein a detecting light transmitted through the image forming body for detecting the registered pattern, includes an infrared ray.

5. The color image forming apparatus of claim 2, wherein a transmissivity of the image forming body relating to a detecting light for detecting the registered pattern, is not less than 70%.

6. The color image forming apparatus of claim 2, further comprising:

a transfer device for transfer the superimposed color image onto a recording sheet, wherein the detector detects a recording sheet conveyed onto the image forming body.

7. The color image forming apparatus of claim 6, wherein the detector detects a leading edge or a trailing edge of the recording sheet.

8. The color image forming apparatus of claim 6, wherein the detector detects a width of the recording sheet.

9. The color image forming apparatus of claim 6, wherein the detector detects a transparent degree of the recording sheet.

10. The color image forming apparatus of claim 6, wherein a detecting light transmitted through the image forming body for detecting the recording sheet, includes an infrared ray.

11. The color image forming apparatus of claim 6, wherein a transmittance of the image forming body relating to a detecting light for detecting the recording sheet, is not less than 70%.

12. The color image forming apparatus of claim 1, wherein the detector includes an image sensor to detect a density pattern composed of respective colored toners formed on the image forming body.

13. The color image forming apparatus of claim 12, wherein the plurality of imagewise exposure devices are provided inside the image forming body, and the apparatus further comprising a supporting body provided inside the image forming body for supporting the plurality of imagewise exposure devices and the image sensor.

14. The color image forming apparatus of claim 12, wherein a detecting light transmitted through the image forming body for detecting the density pattern, includes an infrared ray.

15. The color image forming apparatus of claim 12, wherein a transmissivity of the image forming body relating to a detecting light for detecting the density pattern, is not less than 70%.

16. The color image forming apparatus of claim 12, wherein the image sensor further has a function to detect a registered pattern comprised of respective colored toners formed on the image forming body.

17. The color image forming apparatus of claim 1, further comprising:

a transfer device for transferring the superimposed color image onto a recording sheet, wherein the detector detects an amount of residual toner on the image forming body.

18. The color image forming apparatus of claim 17, further comprising:

a development detector for detecting a developing performance through which a transfer coefficient is obtained.

19. The color image forming apparatus of claim 17, wherein an optimum transfer condition can be set by changing a transfer condition.

20. The color image forming apparatus of claim 17, wherein said detector further has a function to detect a jamming of a recording sheet.

21. The color image forming apparatus of claim 17, wherein a detecting light transmitted through the image forming body for detecting the density pattern, includes an infrared ray.

22. The color image forming apparatus of claim 17, wherein a transmittance of the image forming body relating to a detecting light for detecting the amount of residual toner on the image forming body, is not less than 70%.

23. The color image forming apparatus of claim 1, wherein the detector includes one of: (a) a line type detector and (b) an area type detector.

24. The color image forming apparatus of claim 1, wherein the image forming body has a drum shape.

* * * * *